United States Patent [19]

Logsdon

[11] Patent Number: 4,484,424

[45] Date of Patent: Nov. 27, 1984

[54] ROOF VENT

[76] Inventor: Duane D. Logsdon, P.O. Box 186, Stanton, Calif. 90680

[21] Appl. No.: 408,821

[22] Filed: Aug. 17, 1982

[51] Int. Cl.[3] ..... F24F 7/02; E04F 17/04

[52] U.S. Cl. ..... 52/199; 52/302

[58] Field of Search ..... 52/199, 198, 95, 302, 52/303, 1

[56] References Cited

U.S. PATENT DOCUMENTS

| | | | |
|---|---|---|---|
| 1,931,066 | 10/1933 | Eckert | 52/95 |
| 3,797,181 | 3/1974 | Nievelt | 52/199 |
| 3,984,947 | 10/1976 | Patry | 52/199 |
| 4,015,381 | 4/1977 | Schmidt | 52/199 |
| 4,080,083 | 3/1978 | Malott | 52/199 |
| 4,206,692 | 6/1980 | Johnston | 52/199 |
| 4,265,058 | 5/1981 | Logsdon | 52/199 |
| 4,280,305 | 7/1981 | Logsdon | 52/199 |

*Primary Examiner*—Donald G. Kelly
*Assistant Examiner*—Michael Safavi
*Attorney, Agent, or Firm*—K. H. Boswell; Edward D. O'Brian

[57] ABSTRACT

A roof vent includes a plate and a housing integrally formed together. An opening in the plate extends upwardly into the hollow interior of the housing. A partition located within the housing divides the interior of the housing into an upper and lower section. The partition includes a hole allowing for fluid flow between the upper and lower sections. A diaphragm lays on the upper surface of the partition over the hole in the partition. The diaphragm prevents fluid movement from the upper section of the interior into the lower section of the interior, but allows for reverse flow of fluid. A diaphragm positioning member is located in the upper section and maintains the diaphragm in its position on the partition over the hole in the partition. The diaphragm positioning member includes at least one opening in it allowing for fluid passage between the partition and the diaphragm and through the opening in the diaphragm positioning means. A cap is attached to the upper end of the housing and protects the upper section against the ingress of foreign material into the same. A passage between the ambient and the upper section of the interior is located in either the cap or the upper edge of the housing and allows for fluid movement between the ambient and the upper section of the interior.

10 Claims, 6 Drawing Figures

ROOF VENT

BACKGROUND OF THE INVENTION

This invention is directed to a vent for a roof structure which allows for outgassing of the layers of material which comprise the roof. More specifically, this invention is directed to a one-way vent which allows for passage of gas from between the layers of the roof to the ambient but inhibits reverse flow of gas from the ambient to the layers.

In the construction of certain types of roofs a sub-floor is laid, and asphalt, or other similar material, laid over the sub-floor. Because of the nature of these roofs and the materials of which they are composed, certain gasses are created within the layers of the roofing material which, if unvented, will result in poor performance or breakdown of the roof itself.

Roofs of the type mentioned in the preceding paragraph are generally formed by overlaying a subflooring or the like with an asphalt material. The asphalt material tends to vent out certain gasses which are either trapped within the matrix of the asphalt or are formed from the asphalt itself subsequent to applying the same to the sub-flooring. If these gas bubbles are allowed to form, when subjected to expansion and contraction as the roof is exposed to heat and cold, the gas bubbles will deteriorate the roof because of flexure of the asphalt material as it responds to expansion and contraction of the gas bubble trapped inside.

In order to alleviate the problem of gas build-up within certain roofing structures, vents are utilized which tend to outgas the layers of the roof. Based on the requirements of building codes and the like, these vents are appropriately placed at a fixed distance from one another in order to facilitate the removal of gaseous products trapped within the layers of the roof.

Heretofore, these vents have been of a somewhat complicated nature and because of this, their use is not cost effective. The inclusion of these vents, however, is a necessity if proper performance of the roof is to be achieved. Additionally, while outgassing the roofs, the vents must also prevent reverse fluid flow, such that moisture, dirt and the like do not become trapped within the layers of the roof. The introduction of moisture between the layers of the roof can be highly detrimental in that once so introduced, the moisture tends to promote mold growth and the like which tends to deteriorate the structure of the roof.

BRIEF DESCRIPTION OF THE INVENTION

In view of the above, it is a broad object of this invention to provide a roof vent structure which is capable of being mass-produced from moldable materials which require little or no labor intensive handling in either their manufacture or application to the roof. Further, it is an object of this invention to provide a roof vent which utilizes a unitary structure capable of being formed in a single molding operation as the main basis of the roof vent, and this structure, in combination with auxiliary pieces, is easily and automatically combined to produce the finished roof vent structure. Additionally, it is an object of this invention to provide a roof vent which, because of its engineering principles and economics of manufacture, is both capable of a long, useful service life and is economical, and thus does not substantially increase the total cost of the application of the roof vent to the structure.

These and other objects, as will become evident from the remainder of this specification are achieved in a roof vent structure which comprises: a plate and a housing integrally formed together as a unit; said plate having an opening; said housing formed as an upstanding element having a hollow interior and upper and lower edges, said housing connecting to said plate about its lower edge around said opening in said plate such that said opening is continuous with said hollow interior; said housing including a partition integrally formed with the remainder of said housing, said partition located within said hollow interior and dividing the hollow interior into an upper section and a lower section, said partition including at least one opening extending between and connecting said upper and lowwer sections of said hollow interior, said partition having an upper surface located in said upper section; a diaphragm means located in association with and capable of fitting against said upper surface and sealing said opening in said partition against fluid movement from said upper section to said lower section of said interior when fluid pressure in said upper section of said interior is greater than fluid pressure in said lower section of said interior; a diaphragm positioning means located in said upper section of said interior, said diaphragm positioning means maintaining said diaphragm in association with said partition such that at least a portion of said diaphragm is located over said opening in said partition, at least a portion of said diaphragm positioning means comprising an element located in association with both said partition and the outside periphery of said diaphragm, said element including at least one fluid passageway therein allowing for fluid flow through said element such that when fluid pressure in said lower section of said interior is greater than fluid pressure in said upper section of said interior fluid flows through said opening in said partition and displaces at least a portion of said diaphragm upwardly from said partition allowing for continued fluid flow between said upper surface of said partition and said diaphragm and further through said passageway in said element into said upper section; cap means attaching to said upper edge of said housing, said cap means protecting said upper section of said interior against the ingress of foreign material into said upper section of said interior; at least one of said cap means or said upper edge of said housing including at least one ambient passageway connecting said upper section of said interior to the ambient, said cap means protecting said ambient passageway from the introduction into said ambient passageway of downwardly descending foreign material.

Preferredly, the diaphragm positioning means would include an upwardly projecting skirt means located on the upper surface of the partition with the diaphragm fitting within the skirt means and resting on the upper surface of the partition. The skirt means would include a plurality of horizontally oriented fluid passageways sized and shaped so as to receive fluid flowing from between said diaphragm and said upper surface of said partition and transfer this fluid to the upper section of the interior.

Preferredly, the ambient passageways would be located along the upper edge of the housing with a plurality of these being present and spaced from one another in an array along this upper edge of the housing. In conjunction with this, preferredly, the diaphragm positioning means would further include a perforate means capable of being retained above the diaphragm by fitting onto and being supported by the skirt means.

Preferredly, the skirt means would comprise an annular skirt integrally formed on the upper surface of the partition and projecting upwardly toward the upper edge of the housing. The annular skirt would be positioned on the upper surface of the partition so as to be spaced away from the housing to form a fluid channel between the interior surface of the housing and the exterior surface of the annular skirt. The perforate means would be sized and shaped so as to fit adjacent to the interior surface of the housing and it would contain a plurality of perforations allowing for fluid flow through the perforations from the fluid channel to the upper section of the interior.

Perferredly, the plate would be shaped as a flat plate, capable of being positioned in an abutting relationship between structural members of the roof. More preferredly. this would include the flat plate being positioned between adjacent layers of the roof. Preferredly, the housing would be shaped as a surface of revolution formed by a continuous wall with the ambient passageways comprising a series of crenels located along the upper edge of this continuous wall.

Preferredly, the flat plate would include a plurality of radially projecting grooves located on its underside, with these grooves opening into the hollow interior of the housing and serving as gas-collecting vents when the plate is positioned in an abutting relationship with structural members of the roof.

Preferredly, the cap means would comprise a cap which fits over the upper edge of the housing and it would include the skirt which surrounds the periphery of the cap and projects downwardly over the housing. The cap skirt would be spaced away from the housing when the cap is located on the housing so as to form a narrow gap between the cap skirt and the housing. This gap would serve as an opening allowing for fluid flow between the cap skirt and the housing.

BRIEF DESCRIPTION OF THE DRAWINGS

This invention will be better understood when taken in conjunction with the drawings wherein.

Figure 1:
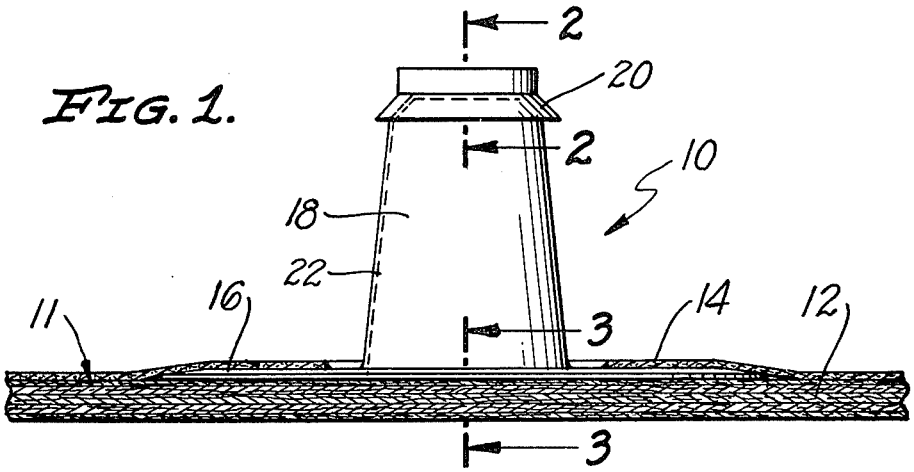
FIG. 1 is a side elevational view in partial section showing placement of the roof vent structure of the invention on a typical layered roof.

The invention described in this specification and illustrated in the drawings is directed to certain principles and/or concepts as are set forth in the claims appended to this specification. Those skilled in the plumbing arts will realize that these principles and/or concepts are capable of being illustrated in a variety of illustrative embodiments. For this reason, this invention is not to be construed as being limited to the exact illustrated embodiment herein, but is only to be construed as being limited by the claims.

DETAILED DESCRIPTION OF THE INVENTION

In FIG. 1, the roof vent 10 of the invention is shown in position on top of a roof 11, which, as depicted, is formed by a sub-roof 12 and an overlaying composition 14. Normally, the sub-roof 12 would be composed of a plywood sheet or the like, with the composition 14 formed of an asphaltic or other similar material which is applied in a semi-liquid state to the sub-roofing 12 and allowed to cure and harden thereon. It is of course recognized that additional components of the roof 11 might also be present. However, for brevity of this disclosure, they are not specifically illustrated.

During the process of formation of the roof 11, and subsequent to its formation, certain gaseous products can be outgassed from the materials which are used to form the roof and/or have been entrapped or entrained in either these materials or between the layers of the roof. In time, these gaseous products can collect and form bubbles or the like which tend to separate the layers of the roof 11. This can be very detrimental to the longevity and function of the roof 11. With continued exposure to the elements, such as the sun during the day and cooling at night, the presence of gaseous bubbles between the sub-roof 12 and the composition 14 can continually stretch the composition 14 and eventually lead to its deterioration. As such, by utilizing a roof vent 10 at periodic intervals along the roof, these gaseous products can be successfully withdrawn and eliminated to the ambient environment. During this process, it is important, however, to prevent the introduction of moisture or other materials into the area located below the composition 14. As is evident, if the subroofing 12 is formed of a wood product or the like, entrapment of moisture between the composition 14 and the sub-roof 12 can lead to rot or mold deterioration of the sub-roof 12. This, of course, is contraindicated.

It is further important in the functioning of the roof vent 10 to prevent the introduction of solid debris, insects and the like through the roof vent to the area between the sub-roof 12 and the composition 14. As such, it is necessary for the roof vent 10 to function such that movement of fluids is only one-way, that is, from the interior of the roof vent 10 to the ambient and not the reverse. While most of the outgassing of gaseous products from the roofing material will be early in the life of the roof 11, it is important however, to maintain the roof vent 10 functional over the life span of the roof 11, due to subsequent incorporation of gaseous products between the composition 14 and the sub-roof 12 such as that which might be formed due to long term exposure of the resins or the like of the sub-roof 12 to continued thermal cycling and upward movement of gasses through the sub-roof 12. Thus, functioning of the roof vent 10 must be of such a nature that it will continue to function during the lifetime of the structure on which it is placed.

The roof vent 10 is broken up into three major component parts. The first of these is a plate 16, which, during construction of the roof 11, is placed over the sub-roof 12 and receives a portion of the composition 14 on its upper surface. This fixedly holds the totality of the roof vent 10 in its position on the roof 11, and seals the roof vent 10 to the composition 14.

The plate 16 is integrally formed by a molding operation with the second of the three major components, the housing 18. The housing 18 is shaped, in its prefered embodiment, as an upstanding surface of revolution. Preferredly, this upstanding surface of revolution would be in the form of a truncated cone as is seen in FIG. 1. In any event, the housing 18 is integrally formed with the plate 16 as a one-piece unit, and no requirement is therefore necessary for moisture seals or the like to be utilized between these two elements.

The third major visible component of the roof vent 10 is the cap 20. The cap 20 is preferredly shaped as shown in FIG. 1 and 2, such that it fits over the top of the roof vent 10, preventing the introduction of rain, snow, foreign objects, insects or the like into the interior of the housing 18, yet allows for certain fluid communication with the ambient.

The housing 18 is formed by a wall 22 which, as noted above, is preferredly formed in a conical shape. Near the top of the housing, the wall 22 bends, forming a steeper section 24, and then straightens up into a straight section 26. The straight section 26 forms the upper edge of the housing 18. It is on this area that the cap 20 is physically joined to the housing 18.

Figure 2:
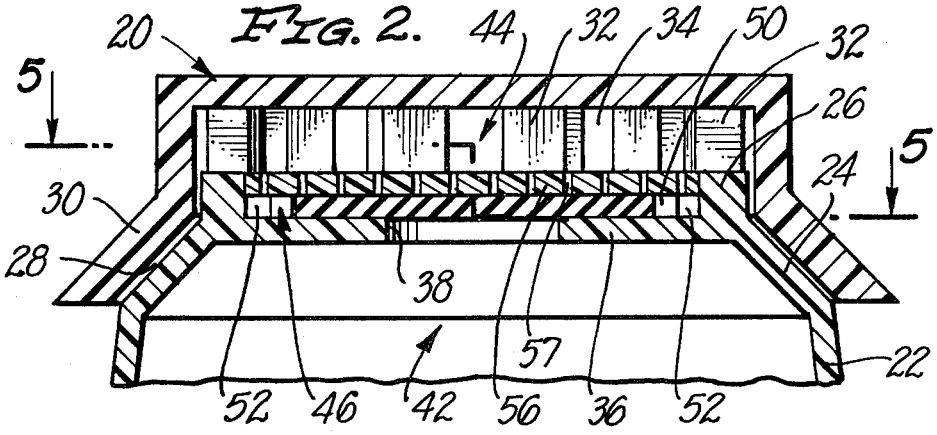
FIG. 2 is an elevation view, in section, about the line 2—2 of FIG. 1.

The profile of the cap 20 as seen in FIG. 2 mimics that of the top of the wall 22 except that the dimensions of the cap 20 are somewhat larger than the dimensions of the top of the housing 18 such that a small space 28 is formed between the skirt 30 of the cap 20 and the steep section 24 of the wall 22. The space 28 continues between the straight section 26 of the wall 22 and the top of the cap 20. The space 28 allows for communication between the ambient environment and the interior of the cap 20 which, in turn, as pointed out below, communicates with the interior of the housing 18.

The upper portion of the straight section 26 of the housing 18 has a square wave, or battlement shape. That is, there is an alternate pattern of areas wherein material is present and areas where material is lacking. The area where material is present can be equated to a series of merlons, collectively identified by the numeral 32, which are seperated by the area where material is lacking, which can be equated to a series of crenels, collectively identified by the numeral 34. The spaces represented by the crenels 34 communicate with the space 28 and thus allow for a fluid passageway from the interior of the housing 18 through the crenel 34 and the space 28 to the ambient atmosphere. The space 28 and the crenels 34 act as a large size sieve or screen (not separately identified or numbered) which inhibits the introduction of solid material such as sand, dirt, insects or the like, into the interior of the housing 18.

Figure 5:
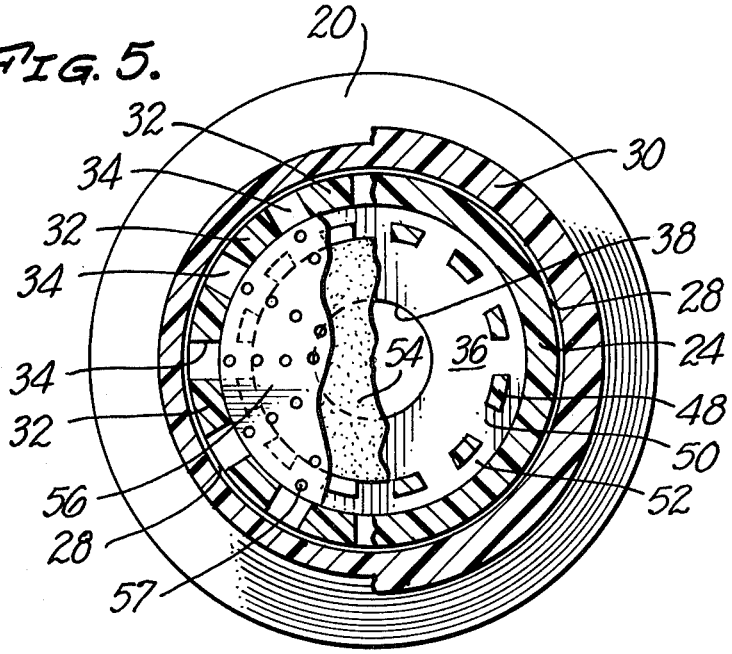
FIG. 5 is a cross-sectional view, in partial section about the line 5—5 of FIG. 2.
Figure 6:
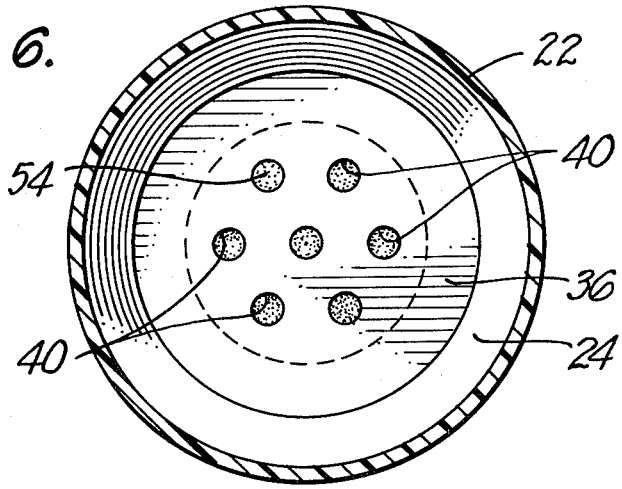
FIG. 6 is a cross-sectional view, looking up, showing an alternate embodiment of the invention.

A partition 36 is integrally formed with the remainder of the housing 18 and extends inwardly within the interior of the housing 18 at the junction of where the steep section 24 meets the straight section 26. In the embodiment of the invention illustrated in FIGS. 2 and 5, the partition 36 includes a singular hole 38. In an alternate embodiment illustrated in FIG. 6, the partition 36 includes a plurality of smaller holes, collectively identified by the numeral 40. Either of the embodiments, whether it be the larger, singular hole 38, or the smaller holes 40, function equivalently, as is indicated below.

The partition 36 divided the interior of the housing 18 into a lower section 42 and an upper section 44. The lower and upper sections 42 and 44 are separated from each other by the partition 36 in all areas except that area wherein either the hole 38 or the holes 40 are located. The holes 38 and 40 form a fluid communication between the lower section 42 and the upper section 44.

Projecting upwardly and integrally formed with the partition 36 is a diaphragm locating skirt 46. As with the upper edge of the housing 18 the diaphragm locating skirt 46 is composed of a series of merlons and crenels, collectively identified by the numerals 48 and 50, respectively. As such, the skirt 46 is in fact not a solid, continuous skirt, but is in fact composed of the series of merlons arranged in a collective array.

The merlons 48 are spaced away from the interior surface of the straight section 26 of the wall 22 by a finite amount. This forms an annular space 52 between the interior surface of the straight section 26 and the merlons 48. The annular space 52 communicates directly with the crenels 50 and in fact is continuous with the same. As such, a fluid passageway exists from within the interior of the skirt 46 horizontally to the exterior of the skirt 46 into the annular space 52 through the crenels 50.

A flexible diaphragm 54 fits within the diaphragm locating skirt 46 on top of the partition 36. The diaphragm 54 is preferredly formed of a rubber-like material allowing it a high degree of flexibility, compressibility and the like. Gravity holds the diaphragm 54 against the top of the partition 36 and the diaphragm 54 therefore covers the opening formed by either the hole 38 or the holes 40, depending upon the particular embodiment of the invention which is utilized. The diaphragm 54 is circular in nature in the preferred embodiment, and thus fits within the skirt 46 which is also circular in the preferred embodiment. It is of course conceivable that both the diaphragm 54 and the skirt 46 could be shaped in a different geometric configuration from that of a circle and still function in an equivalent manner. The choice of circular shapes for these two objects, that is, skirt 46 and diaphragm 54, is governed by the choice of the circular cross-sectional shape of the housing 18, based upon ease of moldability and the like.

The totality of the structure composed of the plate 16, the housing 18 including the partition 36 and the skirt 46 located thereon, is formed of a moldable plastic material which can be conveniently made utilizing suitable molding techniques. The choice of material to be used would take into account certain environmental factors, such as exposure to the elements, temperature variations, and UV radiation and the like. Suitable plastics utilized in the plumbing industry are of course known.

A diaphragm holding means, preferredly formed as perforated disk 56, fits on top of the diaphragm locating skirt 46 over the diaphragm 54. The perforated disk 56 extends outward beyond the periphery of the skirt 46 and abutts adjacent to the inside surface of the straight section 26. The size of the disk 56 is chosen such that the disk can be frictionally fit within the interior of the straight section 26. The frictional fit of the disk 56 ensures that the diaphragm 54 will be maintained in place within the skirt 46 on top of the partition 36. Alternate embodiments of the perforated disk 56 are evident, such as mesh screens and the like. As is evident from viewing FIG. 5, the openings collectively identified by the numeral 57 in the perforated disk 56 communicate with the annular space 52 and thus allow for fluid movement through the perforated disk 56 from the area on top of the perforated disk 56 within the upper section 54 to the annular space 52, and thus to the space defined by the crenels 50.

Figure 4:
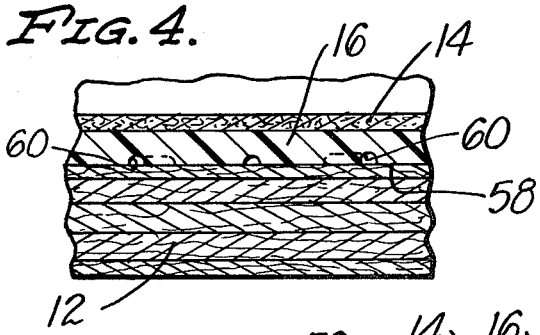
FIG. 4 is an elevational view, in section, about the line 4—4 of FIG. 3.
Figure 3:
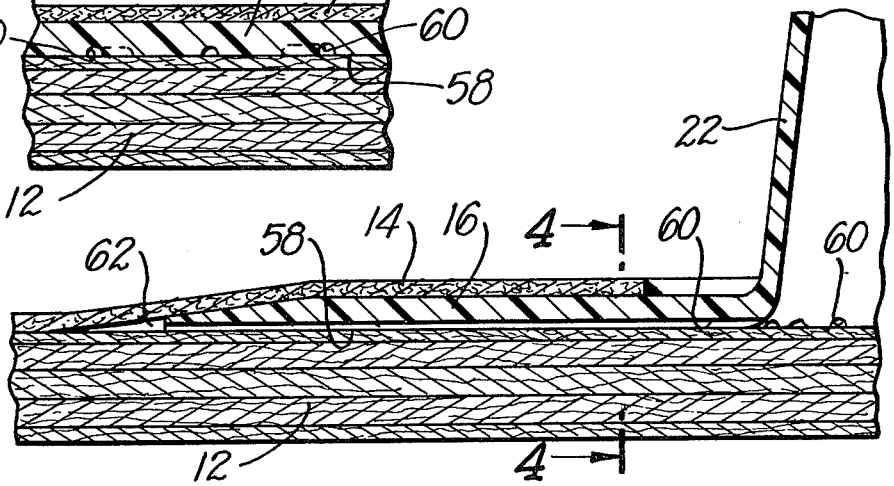
FIG. 3 is an elevational view, in section, about the line 3—3 of FIG. 1.

Located along the bottom surface 58 of the plate 16 are a plurality of gas troughs 60. Preferredly, the gas troughs 60 extend in a symmetrical array and radiate from the housing 18 along the bottom 58 of the plate 16. The gas troughs 60 serve as gas collecting areas on top of the sub-roof 12 between it and the composition 14. The gas troughs 60 help to channel gas flow from along the top of the sub-roof 12 into the lower section 42 of the interior of the housing 18. As can be seen in FIG. 4 the gas troughs 60 are simply hemi-circular in cross-sectional area in their preferred form. It is also noted that the periphery 62 of the plate 16 tapers down such that there is a smooth flow of the composition 14 from the sub-roof 12 over the top of the plate 16.

In operation, the roof vent 10 works as follows. When there is a greater gas pressure within the lower section 42 than that in the upper section 44 such as might be created when gasses are being vented from between the sub-roof 12 and the composition 14, this greater gas pressure causes fluid flow upward through the hole 38 in the embodiment of FIGS. 2 and 5 or through the hole 40 in the embodiment of FIG. 6 toward the upper section 44. The fluid flow strikes the bottom of the diaphragm 54 and compresses the diaphragm 54 upwardly against the perforated disk 56. This allows fluid flow between the diaphragm 54 and the top surface of the partition 36. This fluid flow continues toward the periphery of the diaphragm 54 until the fluid flow meets the skirt 46. At this point, the fluid flow is no longer confined between the lower surface of the diaphragm 54 and the upper surface of the partition 36, but enters into the space created by the crenels 50. Fluid flow then flows through the crenels 50 and into the annular space 52. Since the annular space 52 communicates through the perforated disk 56 to the upper section 44 of the interior of the housing 18, fluid can now flow upward through the perforated disk 56 and become located within the upper section 44 of the interior of the housing 18. From this point, fluid then flows through the crenels 50 which are located in the straight section 26 of the wall 22 of the housing 18 and into the space 28 between the housing 18 and the cap 20. From here, fluid is then vented to the ambient.

The reverse fluid passage, however, is not possible. If, for some reason, there is a greater pressure in the ambient than that within the lower section 42 of the interior of the housing 18, this fluid pressure communicating through the space 28 and through the openings formed by the crenels 34 is passed through the perforated disk 56 to the annular space 52 and, additionally, through the perforated disk 56 to the top of the diaphragm 54. The pressure on the top of the diaphragm 54 pushes the diaphragm 54 down against the partition 36. This seals the diaphragm 54 against the partition 36 and prohibits fluid flow from the annular space 52 through the crenels 50 between the diaphragm 54 and the partition 36. By inhibiting fluid flow from the ambient into the lower section 42 of the interior of the housing 18, this prohibits the introduction of moisture which might be carried along in the fluid from being introduced into the lower section 42 of the interior of the housing 18. Thus, moisture is prohibited from being introduced between the composition 14 and the sub-roof 12, maintaining a dry environment within this area. Further, as was noted above, the space 28 as well as the crenels 34 form a gross screen to prohibit the introduction of foreign matter or the like into the interior of the roof vent 10. Additionally, the holes 57 in the perforated disk 56 prevent the introduction of foreign matter or the like between the diaphragm 54 and the partition 36. The fluid pathway formed by the space 28 and the area formed by the crenels 34 is sufficiently tortuous that the introduction of material into the upper section 44 of the interior of the housing 18 is improbable. However, the probability exists that small insects or the like could successfully negotiate this tortuous pathway. The holes 57 in the perforated disk 56 however, are of a sufficiently small diameter to prevent such insects or the like from getting underneath the diaphragm 54 and thus breaking the seal of the diaphragm 54 against the partition 36 when there is a greater pressure in the upper section 44 than the lower section 42 of the interior of the housing 18.

Preferredly, the totality of the plate 16, the housing 18 and all components thereof, are formed in a single molding operation. The diaphragm 54 is then introduced within the skirt 46 and the perforated disk 56 is placed thereon. Placement of the cap 20 on the top of the housing 18 thus finishes the assembly of the roof vent 10. As was noted above, preferredly, the perforated disk 56 frictionally fits within the interior of the straight section 26 of the wall 22 of the housing 18 and thus prevents movement of the diaphragm 54 from its location within the skirt 46. The cap 20 is preferredly fixedly attached to the top of the housing 18 by solvent welding, thermal bonding or other suitable and equivalent techniques. Thus, once assembled, the roof vent 10 remains attached for the totality of its lifetime. The roof vent 10 is easily attached to the structure on which it will remain by simply setting it on the sub-roof 12 and suitably sealing it in position when the composition 14 is appropriately introduced on to the top of the sub-roof 12 by spreading, pouring or the like.

I claim:

1. A roof vent structure which comprises:

a plate and housing integrally formed together as a unit;

said plate having an opening;

said housing formed as an upstanding element having a hollow interior and upper and lower edges, said housing connecting to said plate about its lower edge around said opening in said plate such that said opening is continuous with said hollow interior;

said housing including a partition integrally formed with the remainder of said housing, said partition located within said hollow interior spaced downwardly from said upper edge and dividing the hollow interior of said housing into an upper section and a lower section, said partition including at least one opening extending between and connecting said upper and lower sections of said hollow interior, said partition having an upper surface located in said upper section;

an imperforate diaphragm independent of said partition and contiguously resting directly against said upper surface of said partition and sealing said opening in said partition against fluid movement from said upper section to said lower section of said interior when said fluid pressure in said upper section is greater than fluid pressure in said lower section of said interior;

a diaphragm positioning means located in said upper section of said interior and above said imperforate diaphragm, said diaphragm positioning means for maintaining said diaphragm in association with said partition such that at least a portion of said diaphragm is located over said opening in said partition in direct contact with said partition, at least a portion of said diaphragm positioning means comprising an element located in association with both said partition and the outside periphery of said diaphragm, said element including at least one fluid passageway therein allowing fluid flow through said element such that when fluid pressure in said lower section of said interior is greater than fluid pressure in said upper section of said interior fluid flows through said opening in said partition and displaces at least a portion of said diaphragm upwardly from said partition allowing for continued fluid flow between said diaphragm and further through said passageway in said element into said upper sections;

cap means attaching to said upper edge of said housing, said cap means protecting said upper section of said interior against ingress of foreign material into said upper section of said interior;

at least one of said cap means or said upper edge of said housing including at least one ambient passageway connecting said upper section of said interior to the ambient, said cap means protecting said ambient passageway of downwardly descending foreign material.

2. The structure of claim 1 wherein:

said diaphragm positioning means includes an upwardly projecting skirt means located on the upper surface of said partition, said diaphragm fitting within said skirt means and resting on said upper surface of said partition;

said skirt means including a plurality of horizontally oriented fluid passageways sized and shaped so as to receive fluid flowing between said diaphragm and said upper surface of said partition and transfer said fluid to said upper section of said interior.

3. The structure of claim 2 wherein:

said ambient passageway is located in said upper edge of said housing.

4. The structure of claim 3 including:

a plurality of ambient passageways located on said upper edge of said housing and spaced from one another in an array.

5. The structure of claim 4 wherein:

said diaphragm positioning means further includes perforated means capable of being retained above and said diaphragm by fitting onto and being supported by said skirt means.

6. The structure of claim 5 wherein:

said skirt means comprises an annular skirt integrally formed on the upper surface of said partition and projecting upwardly toward said upper edge of said housing, said annular skirt positioned on said upper surface of said partition so as to be spaced away from the interior surface of said housing to form a fluid channel between the interior surface of said housing and the exterior surface of said annular skirt;

said perforated means sized and shaped to fit adjacent to the interior surface of said housing, said perforated means containing a plurality of perforations allowing for fluid flow through said perforated means between said fluid channel and said upper section of said interior.

7. The structure of claim 6 wherein:

said plate comprises a flat plate capable of being positioned in an abutting relationship with structural members of a roof;

said housing is shaped as a surface of revolution formed by a continuous wall.

8. The structure of claim 7 wherein:

said ambient passageways comprise a series of crenels located along said upper edge of said housing.

9. The structure of claim 8 wherein:

said flat plate includes a plurality of radially projecting gas troughs located on its underside, said gas troughs opening into said hollow interior of said housing and serving as gas collecting vents when said plate is in an abutting relationship with structural members of a roof.

10. The structure of claim 9 wherein:

said cap means comprises a cap fitting over the upper edge of said housing and including a cap skirt surrounding the periphery of said cap, said cap skirt spaced away from said housing when said cap is located on said housing so as to form a narrow gap between said cap skirt and said housing serving to allow fluid flow between said cap skirt and said housing.

* * * * *